US011976866B2

(12) United States Patent
Seo

(10) Patent No.: US 11,976,866 B2
(45) Date of Patent: May 7, 2024

(54) TRANSPARENT ICE MANUFACTURING SYSTEM AND METHOD FOR MANUFACTURING TRANSPARENT ICE BY USING THE SAME

(71) Applicant: INTYCO Co., Ltd., Uiwang-si (KR)

(72) Inventor: Sang Jun Seo, Seongnam-si (KR)

(73) Assignee: INTYCO Co., Ltd., Uiwang-si (KR)

( * ) Notice: Subject to any disclaimer, the term of this patent is extended or adjusted under 35 U.S.C. 154(b) by 174 days.

(21) Appl. No.: 17/578,270

(22) Filed: Jan. 18, 2022

(65) Prior Publication Data

US 2023/0204270 A1 Jun. 29, 2023

Related U.S. Application Data

(63) Continuation of application No. PCT/KR2022/000479, filed on Jan. 11, 2022.

(30) Foreign Application Priority Data

Dec. 24, 2021 (KR) ..... 10-2021-0186823

(51) Int. Cl.
*F25C 1/20* (2006.01)
*F25C 1/12* (2006.01)
(Continued)

(52) U.S. Cl.
CPC ..... *F25C 1/20* (2013.01); *F25C 1/12* (2013.01); *F25C 1/25* (2018.01); *F25C 5/04* (2013.01); *F25C 2400/14* (2013.01)

(58) Field of Classification Search
CPC ..... F25C 1/18; F25C 1/16; F25C 1/20; F25C 1/25; F25C 5/04; F25C 2400/14;
(Continued)

(56) References Cited

U.S. PATENT DOCUMENTS 2,722,110 A * 11/1955 Denzer ..... F25C 1/045 62/352
4,417,716 A * 11/1983 Penna ..... F25C 1/243 249/129
(Continued)

FOREIGN PATENT DOCUMENTS

CN 101473178 * 1/2009 ..... F25C 1/22
KR 10-2032824 B1 10/2019
WO WO 03/033974 * 4/2003 ..... F25C 5/14

OTHER PUBLICATIONS

Machine English Language Translation of WO03/033974 to Kondou et al., (translated Sep. 2023) (Year: 2003).*
(Continued)

*Primary Examiner* — Cassey D Bauer
(74) *Attorney, Agent, or Firm* — Studebaker & Brackett PC

(57) ABSTRACT

Disclosed is a transparent ice manufacturing system including a reservoir tank, in which a liquid is stored, a mold having a cavity, in which the liquid supplied from the reservoir tank is filled to form ice, a cooling part that cools one area of the mold to manufacture ice while freezing the liquid from the one area to an opposite area of the mold, and a fluid circulation part provided between the reservoir tank and the mold, and that circulates the liquid between the reservoir tank and the cavity while the liquid is frozen in the cavity.

11 Claims, 17 Drawing Sheets

(51) Int. Cl.
*F25C 1/25* (2018.01)
*F25C 5/04* (2006.01)

(58) Field of Classification Search
CPC ..... F25C 1/22; F25C 2400/08; F25C 1/24; F25C 1/12; F25D 2323/122
See application file for complete search history.

(56) References Cited

U.S. PATENT DOCUMENTS

| | | | | |
|---|---|---|---|---|
| 9,074,802 | B2 * | 7/2015 | Culley | F25C 1/25 |
| 2012/0227422 | A1 * | 9/2012 | Schoonen | F25C 1/12 62/340 |

OTHER PUBLICATIONS

Machine English Language Translation of CN101473178 to Takagi et al., (translated Sep. 2023) (Year: 2009).*

* cited by examiner

TRANSPARENT ICE MANUFACTURING SYSTEM AND METHOD FOR MANUFACTURING TRANSPARENT ICE BY USING THE SAME

CROSS-REFERENCE TO RELATED APPLICATIONS

The present application is a continuation of International Patent Application No. PCT/KR2022/000479, filed on Jan. 11, 2022, which is based upon and claims the benefit of priority to Korean Patent Application No. 10-2021-0186823, filed on Dec. 24, 2021 to the Korean Intellectual Property Office, the entire contents of which are hereby incorporated by reference.

BACKGROUND

The inventive concept relates to a transparent ice manufacturing system and a method for manufacturing transparent ice by using the same.

In general, ice includes opaque ice and transparent ice.

The opaque ice is obtained by freezing water containing impurities and air, and has an opaque color.

The transparent ice is obtained by freezing water that does not contain impurities and air, and has a transparent color.

The transparent ice is not melt better than the opaque ice. For example, in an environment of 23° C., the transparent ice is thawed after 3 hours and 49 minutes, but the opaque ice is thawed after 2 hours and 34 minutes. Furthermore, in an environment of 31° C., the transparent ice is thawed after 1 hour and 34 minutes, but the opaque ice is thawed after 1 hours and 22 minutes.

The reason why the transparent ice is not melt better than the opaque ice is that an exposure area of transparent ice is rather narrow because there is no air tunnel due to impurities and air, but an exposure area of opaque ice is rather wide because there is air tunnels due to impurities and air.

A conventional transparent ice manufacturing system manufactures a large capacity of opaque ice by freezing a large capacity of water at once, separates the large capacity of opaque ice frozen by an ice maker, cutting the large capacity of opaque ice into a plurality of opaque ice pieces by a carver, crushes unnecessary parts of the plurality of opaque ice pieces to manufacture a plurality of transparent ice pieces, and in turn forms the plurality of transparent ice pieces into shapes corresponding to a final product.

In this way, according to the conventional transparent ice manufacturing system, a manufacturing time for transparent ice increases as a manufacturing process for the transparent ice becomes very complex, and energy consumptions, such as electric power, which are necessary for manufacturing transparent ice increase.

Furthermore, according to the conventional transparent ice manufacturing system, raw materials are wasted because unnecessary parts of the transparent ice are discarded through carving, crushing, and forming.

SUMMARY

An aspect of the inventive concept provides a transparent ice manufacturing system and a method for manufacturing transparent ice by using the same, by which a manufacturing time for the transparent ice may be shortened by simplifying a manufacturing process for the transparent ice, energy consumptions such as electric power that is necessary for manufacturing the transparent ice may be reduced, and a manufacturing efficiency of the transparent ice may be enhanced.

Another aspect of the inventive concept provides a transparent ice manufacturing system and a method for manufacturing transparent ice by using the same, by which a quality of transparent ice may be easily managed, and transparent ice of various shapes and various kinds may be manufactured.

An aspect of the inventive concept provides a transparent ice manufacturing system and a method for manufacturing transparent ice by using the same, by which because transparent ice is manufactured by filling the liquid in the cavity of a shape corresponding to a final product and then freezing the liquid, parts that are not necessary in the transparent ice may be prevented from being discarded through the carving, the crushing, and the forming and raw materials may be prevented from being wasted.

The technical objects of the inventive concept are not limited to the above-mentioned ones, and the other unmentioned technical objects will become apparent to those skilled in the art from the following description.

According an embodiment of the inventive concept, a transparent ice manufacturing system includes a reservoir tank, in which a liquid is stored, a mold having a cavity, in which the liquid supplied from the reservoir tank is filled to form ice, a cooling part that cools one area of the mold to manufacture ice while freezing the liquid from the one area to an opposite area of the mold, and a fluid circulation part provided between the reservoir tank and the mold, and that circulates the liquid between the reservoir tank and the cavity while the liquid is frozen in the cavity.

Furthermore, the mold may include a first mold and a second mold that are coupled to each other to be separable while forming the cavity.

Furthermore, the transparent ice manufacturing system may further include a pair of forming molds having an auxiliary cavity that forms ice of a specific shape, and coupled to a cavity formed in the first mold and a cavity formed in the second mold to be separable.

Furthermore, the transparent ice manufacturing system may further include a coupling recess formed in any one of the first mold and the second mold, and a coupling boss protruding from the other of the first mold and the second mold, coupled to the coupling recess to be separable, and combining and arranging the first mold and the second mold.

Furthermore, the fluid circulation part may include a liquid supply pump that pumps and supply the liquid stored in the reservoir tank to the cavity formed by the first mold and the second mold, a first flow passage that guides flows of the liquid pumped by the liquid supply pump to the cavity, and a second flow passage that guides flows of the liquid discharged from the cavity to the reservoir tank.

Furthermore, the fluid circulation part may further include an air pump that suctions air in the cavity formed by the first mold and the second mold, or discharges air stored in the reservoir tank into the cavity.

Furthermore, the liquid supply pump may be provided in the first flow passage, and the air pump may be provided in the second flow passage.

Furthermore, the transparent ice manufacturing system may further include a controller that relieves the remaining liquid left in the cavity to the reservoir tank before the ice frozen in the cavity is separated from the cavity.

Furthermore, the controller may relieve the remaining liquid left in the cavity to the reservoir tank and then separating the ice frozen in the cavity from the cavity by discharging the air accommodated in the reservoir tank into the cavity.

Furthermore, the transparent ice manufacturing system may further include a relief valve provided in the reservoir tank, and that ejects air in the reservoir tank to an outside when a pressure in the reservoir tank is a preset pressure or more.

Furthermore, the transparent ice manufacturing system may further include an agitation part that agitates the liquid filled in the cavity.

Furthermore, the transparent ice manufacturing system may further include a liquid tank, in which the liquid supplied to the reservoir tank is stored, and a liquid supply part that supplies the liquid stored in the liquid tank to the reservoir tank such that a constant amount of the liquid stored in the reservoir tank is maintained.

Furthermore, the cooling part may be provided in any one of the first mold and the second mold, and the fluid circulation part may be provided in the other of the first mold and the second mold.

According another embodiment of the inventive concept, a method for manufacturing transparent ice by using the transparent ice manufacturing system may include suctioning the air in the cavity formed by the mold, filling the liquid stored in the reservoir tank in the cavity, cooling the one area of the mold to manufacture the ice while freezing the liquid from the one area to the opposite area of the mold, by the cooling part, circulating the liquid between the reservoir tank and the cavity while the liquid is frozen in the cavity, relieving the remaining liquid left in the cavity to the reservoir tank before the ice frozen in the cavity is separated from the cavity, and separating the ice frozen in the cavity from the cavity by discharging the air accommodated in the reservoir tank into the cavity.

Detailed items of the other embodiments are included in the detailed description and the accompanying drawings.

BRIEF DESCRIPTION OF THE FIGURES

The above and other objects and features will become apparent from the following description with reference to the following figures, wherein like reference numerals refer to like parts throughout the various figures unless otherwise specified, and wherein.

DETAILED DESCRIPTION

Figure 1:
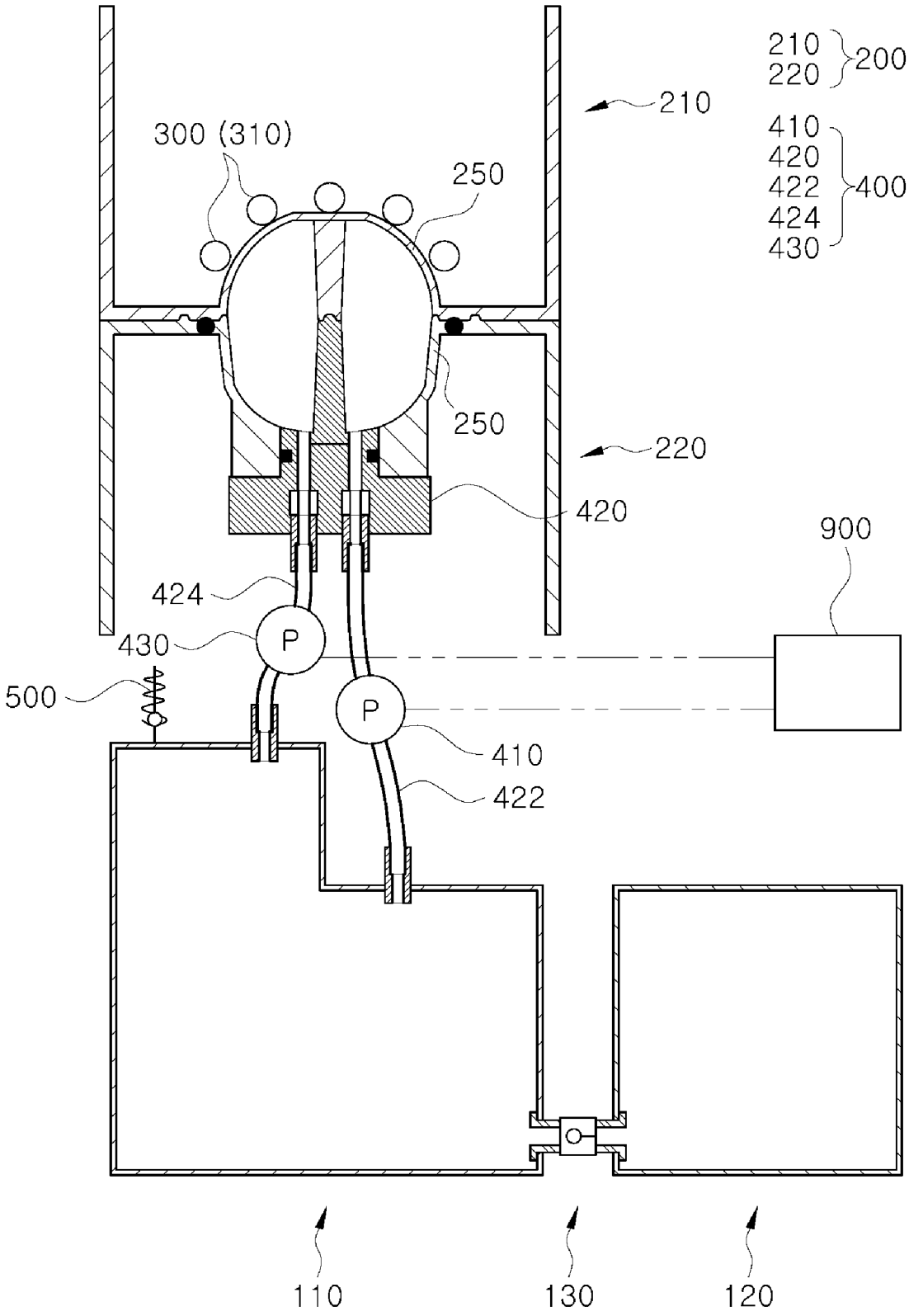
FIG. 1 is a schematic view illustrating a transparent ice manufacturing system according to an embodiment of the inventive concept.

The above and other aspects, features, and advantages of the inventive concept will become apparent from the following description of the following embodiments given in conjunction with the accompanying drawings. However, the inventive concept is not limited by the embodiments disclosed herein but will be realized in various different forms, and the embodiments are provided only to make the disclosure of the inventive concept complete and fully inform the scope of the inventive concept to an ordinary person in the art, to which the inventive concept pertains, and the inventive concept will be defined by the scope of the claims.

The terms used herein are provided to describe the embodiments but not to limit the inventive concept. In the specification, the singular forms include plural forms unless particularly mentioned. The terms "comprises" and/or "comprising" used herein does not exclude presence or addition of one or more other elements, in addition to the aforementioned elements. Throughout the specification, the same reference numerals denote the same elements, and "and/or" includes the respective elements and all combinations of the elements. Although "first", "second" and the like are used to describe various elements, the elements are not limited by the terms. The terms are used simply to distinguish one element from other elements. Accordingly, it is apparent that a first element mentioned in the following may be a second element without departing from the spirit of the inventive concept.

Unless otherwise defined, all terms (including technical and scientific terms) used herein have the same meaning as commonly understood by those skilled in the art to which the inventive concept pertains. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein.

The terms, such as "below", "beneath", "lower", "above", and "upper", which are spatially relative may be used to easily describe a correlation between one element and other elements as illustrated in the drawings. The spatially relative terms have to be understood as terms including different directions of the elements during use or an operation, in addition to the direction illustrated in the drawings. For example, when the elements illustrated in the drawings are overturned, the elements "below" or "beneath" another element may be positioned "above" the other element. Accordingly, the term "below" or "beneath" may include "below" or "beneath" and "above". The element may be oriented in different directions, and accordingly, the spatially relative terms may be construed according to the orientation.

Hereinafter, exemplary embodiments of the inventive concept will be described in detail with reference to the accompanying drawings.

Figure 3:
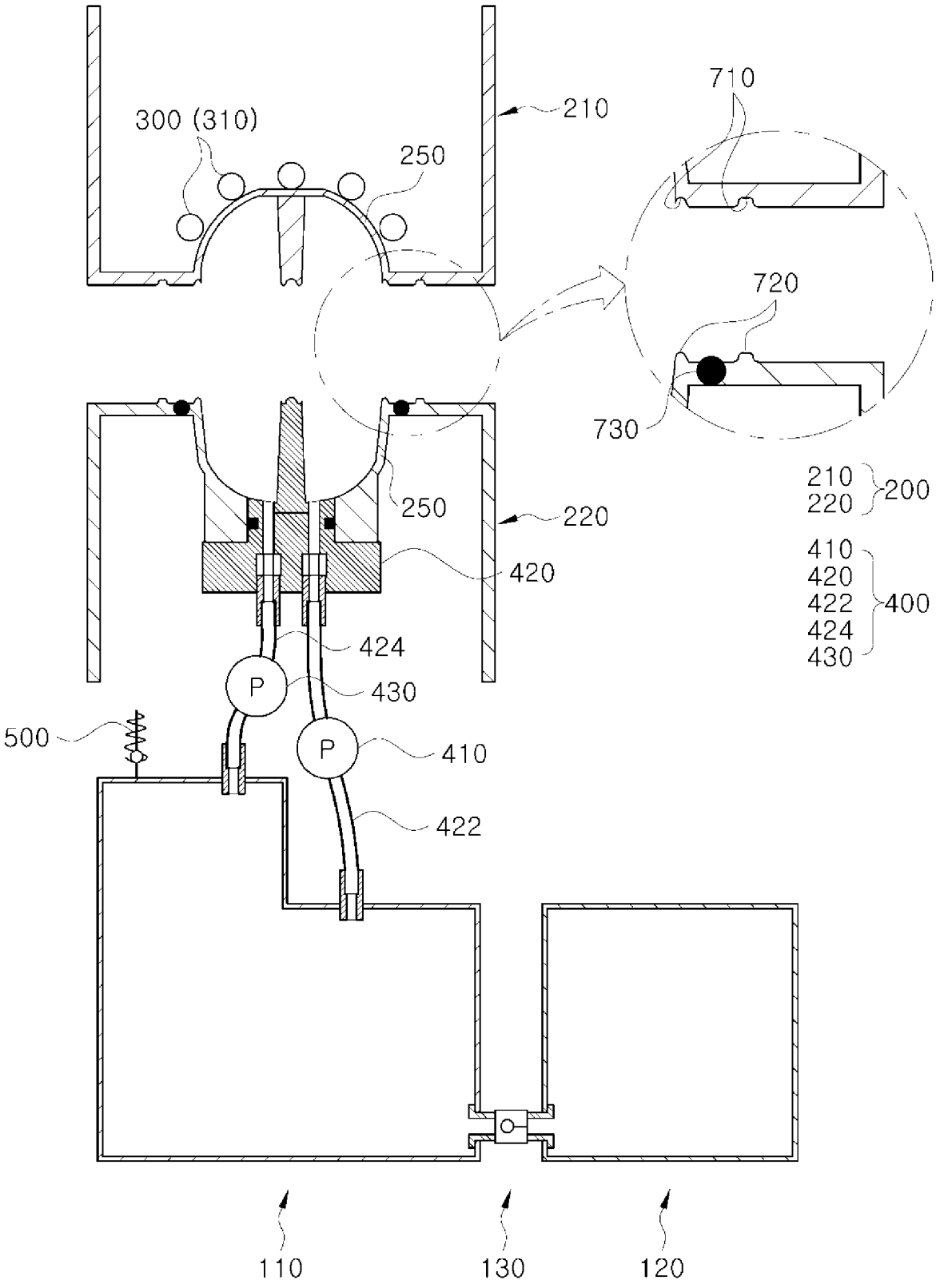
FIGS. 3 and 4 are schematic views illustrating a coupling recess and a coupling boss of a transparent ice manufacturing system according to an embodiment of the inventive concept.
Figure 4:
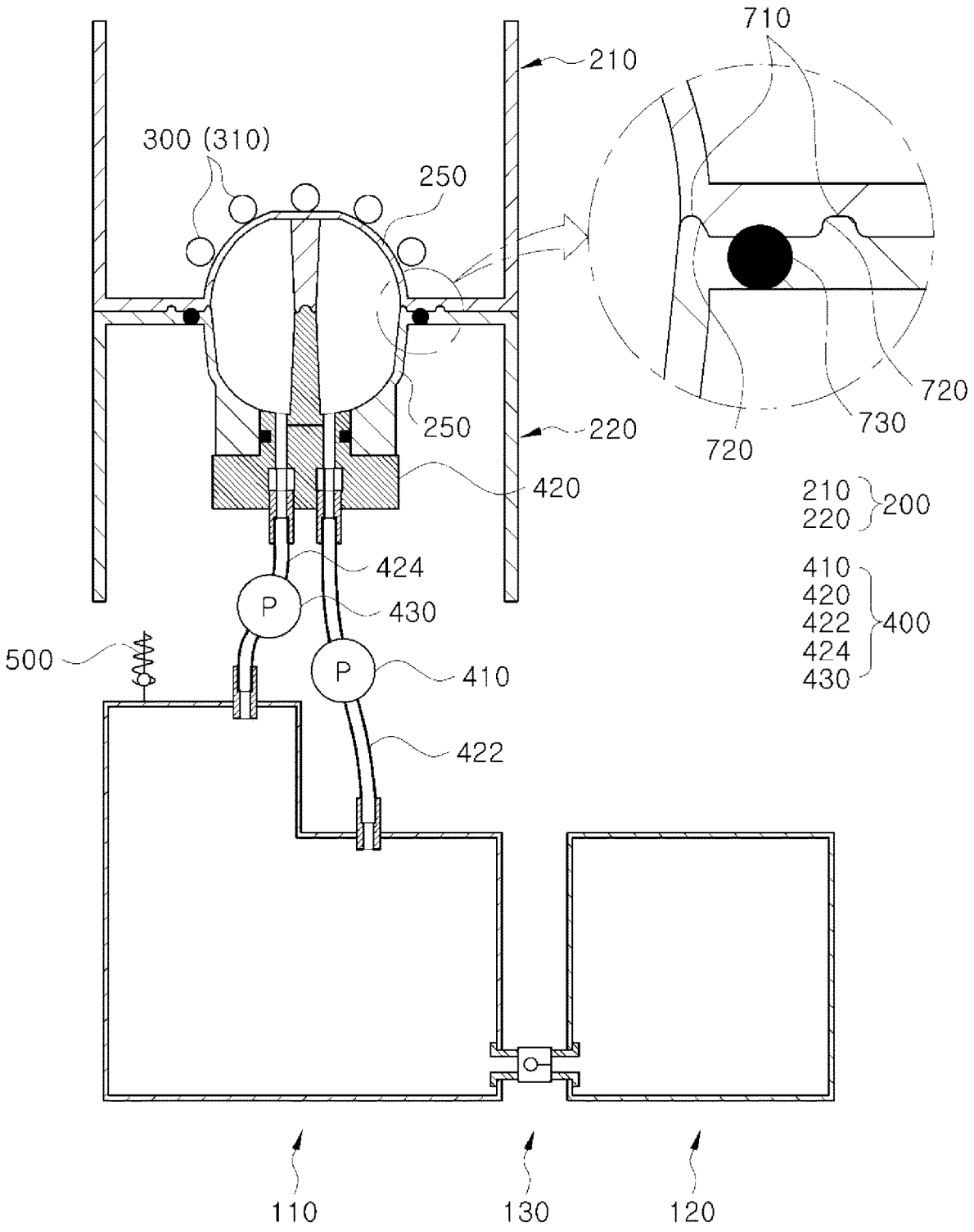
Figure 5:
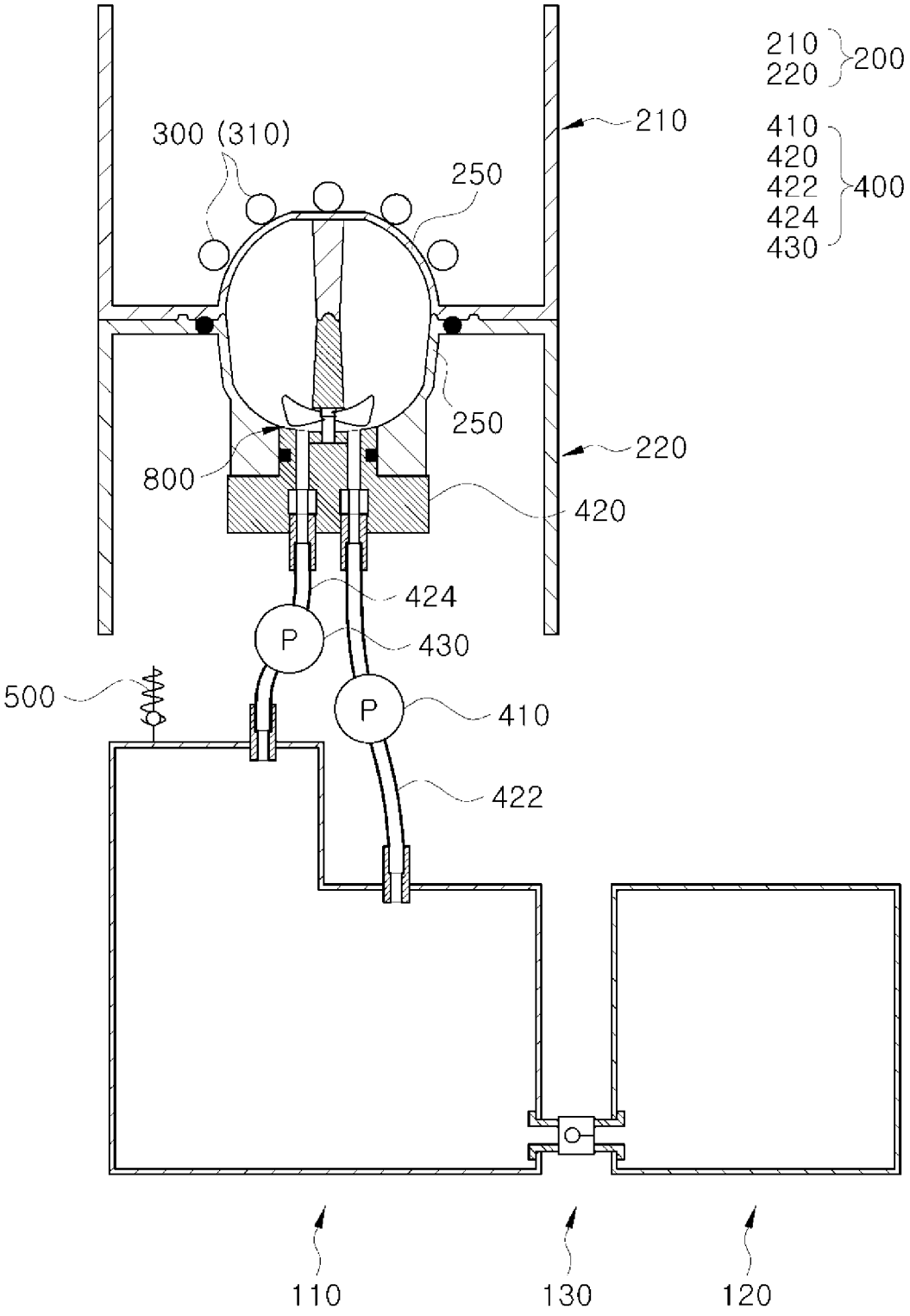
FIG. 5 is a schematic view illustrating an agitation part of a transparent ice manufacturing system according to an embodiment of the inventive concept.
Figure 6:
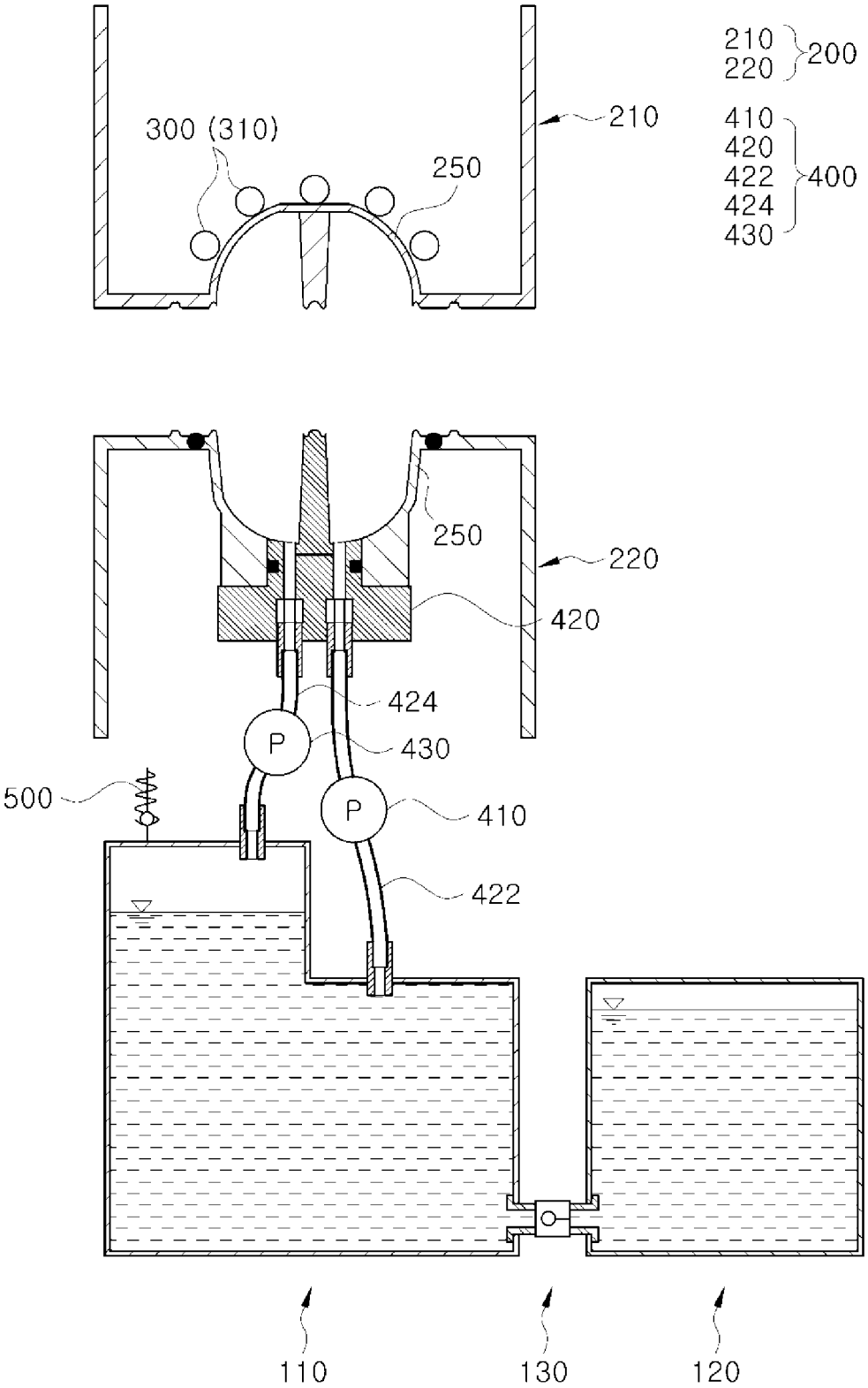
FIGS. 6 to 11 are schematic views illustrating a process of manufacturing transparent ice by a transparent ice manufacturing system according to an embodiment of the inventive concept.

FIG. 1 is a schematic view illustrating a transparent ice manufacturing system according to an embodiment of the inventive concept. FIGS. 2A, 2B, 2C, 2D, and 2E are schematic views illustrating various examples of a cooling part of a transparent ice manufacturing system according to an embodiment of the inventive concept. FIGS. 3 and 4 are schematic views illustrating a coupling recess and a coupling boss of a transparent ice manufacturing system according to an embodiment of the inventive concept. FIG. 5 is a schematic view illustrating an agitation part of a transparent ice manufacturing system according to an embodiment of the inventive concept. FIG. 6 is a schematic view illustrating an agitation part of a transparent ice manufacturing system according to an embodiment of the inventive concept.

As illustrated in FIG. 1, a transparent ice manufacturing system according to an embodiment of the inventive concept includes a reservoir tank 110, a mold 200, a cooling part 300, and a fluid circulation part 400.

A liquid that is to be supplied into a cavity 250 of the mold 200 is stored in the reservoir tank 110. Here, the liquid may be water, a drinking water, a chemical or a chemical liquid. The reservoir tank 110 has a sealed container shape for storing the liquid.

A constant amount of the liquid may normally be stored in the reservoir tank 110 by a liquid tank 120 and a liquid supply part 130.

The liquid that is to be supplied to the reservoir tank 110 is stored in the liquid tank 120. The liquid tank 120 has a container shape for storing the liquid. Here, the liquid tank 120 may supplied the preliminarily cooled liquid to the reservoir tank 110. Accordingly, as the preliminarily cooled liquid is filled in the cavity 250, a freezing efficiency of the liquid filled in the cavity 250 may be improved later.

A scheme of preliminarily cooling the liquid stored in the liquid tank 120 is not particularly limited, but various embodiments of the cooling part 300, which will be described below, may be applied.

The liquid supply part 130 functions to supply the liquid stored in the liquid tank 120 to the reservoir tank 110 such that a constant amount of the liquid stored in the reservoir tank 110 is maintained. For example, the liquid supply part 130 may be a volumetric pump that connects the liquid tank 120 and the reservoir tank 110 and supplies a constant amount of the liquid stored in the liquid tank 120 to the reservoir tank 110.

The mold 200 has the cavity 250, in which the liquid supplied to the reservoir tank 110 is filled to form ice 10. Here, the cavity 250 may have a shape corresponding to the frozen ice 10 that is a final product. Accordingly, because the ice 10 frozen in the cavity 250 has a shape corresponding to the final product, it is not necessary to carve, crush, and form the ice 10. As a result, because the ice 10 frozen in the inventive concept does not cause parts that are discarded through the carving, the crushing, and the forming, raw materials may be prevented from being wasted.

The mold 200 may include a first mold 210 and a second mold 220.

The first mold 210 and the second mold 220 form the cavity 250 and may be coupled to each other to be separable. For example, the first mold 210 may be disposed on an upper side of the second mold 220, and the first mold 210 may form an upper portion of the cavity 250 and the second mold 220 may form a lower portion of the cavity 250. Furthermore, the first mold 210 may be moved toward the second mold 220 by a driving unit such as a lift, and the second mold 220 may be provided in the fluid circulation part 400.

The cooling part 300 manufactures the ice 10 by cooling one area of the mold 200 and freezing the liquid filled in the cavity 250 from the one area to an opposite area of the mold 200. In this way, when the liquid filled in the cavity 250 is frozen by the cooling part 300, the fluid circulation part 400, which will be described below, may circulate the liquid filled in the cavity 250 between the reservoir tank 110 and the cavity 250 continuously or intermittently to remove bubbles contained in the liquid filled in the cavity 250.

The cooling part 300 may be provided in the first mold 210, and the fluid circulation part 400, which will be described blow, may be provided in the second mold 220. Then, the cooling part 300 may manufacture the ice 10 by cooling the first mold 210 and freezing the liquid filled in the cavity 250 from the first mold 210 to the second mold 220.

Figure 2A:
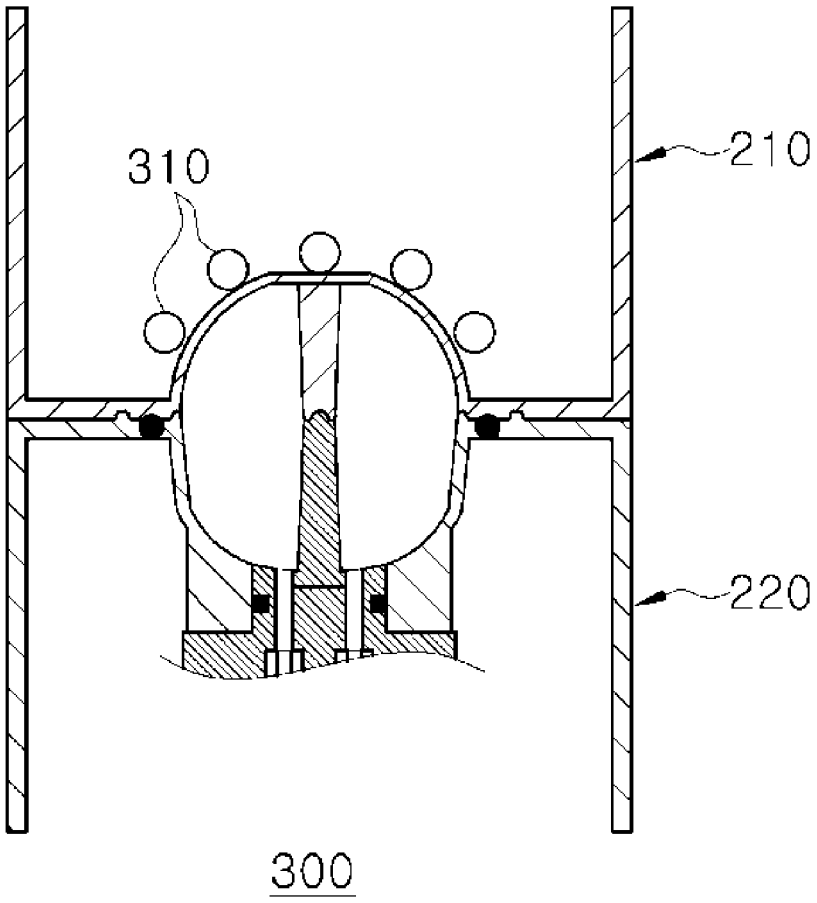
FIGS. 2A, 2B, 2C, 2D, and 2E are schematic views illustrating various examples of a cooling part of a transparent ice manufacturing system according to an embodiment of the inventive concept.

In an embodiment, referring to FIG. 2A, the cooling part 300 may include a plurality of cooling channels 310 that is formed in the first mold 210 such that a refrigerant circulates therein. Here, the refrigerant may be brine or a gas of a low temperature.

Figure 2B:
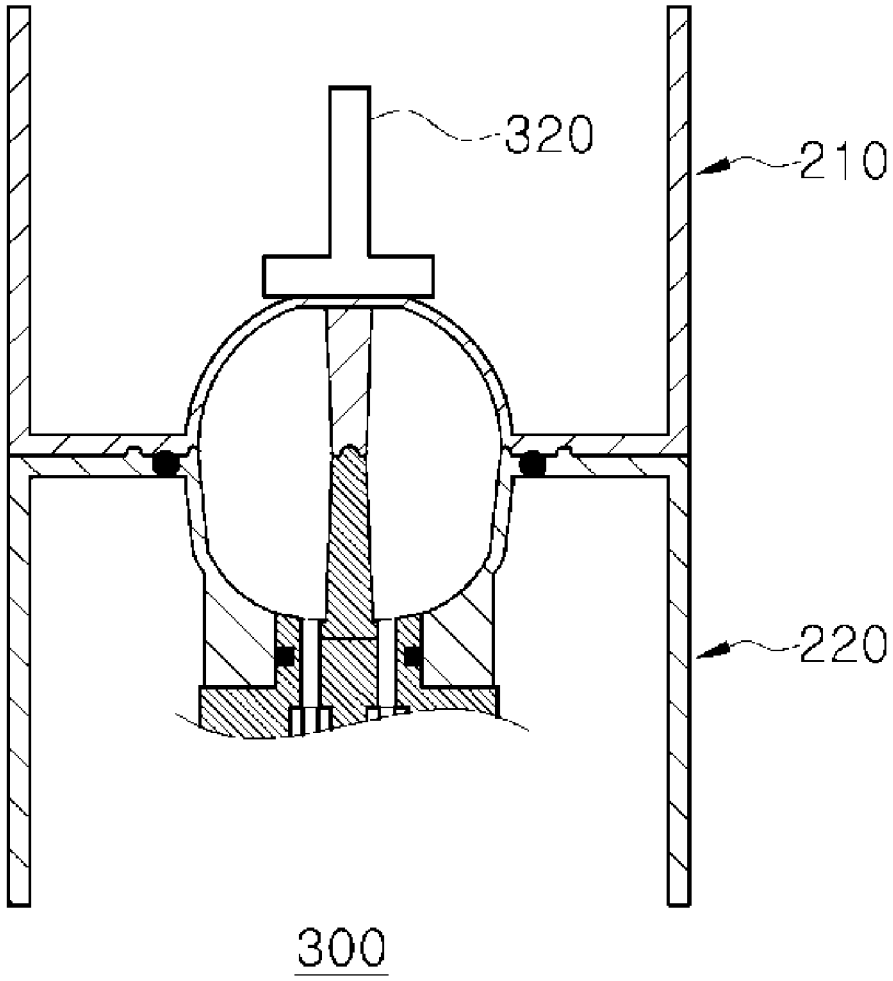

Furthermore, referring to FIG. 2B, the cooling part 300 may include a cooling pad 320 that is formed in the first mold 210 such that the refrigerant circulates therein. Here, the refrigerant may be brine or a gas of a low temperature.

Figure 2C:
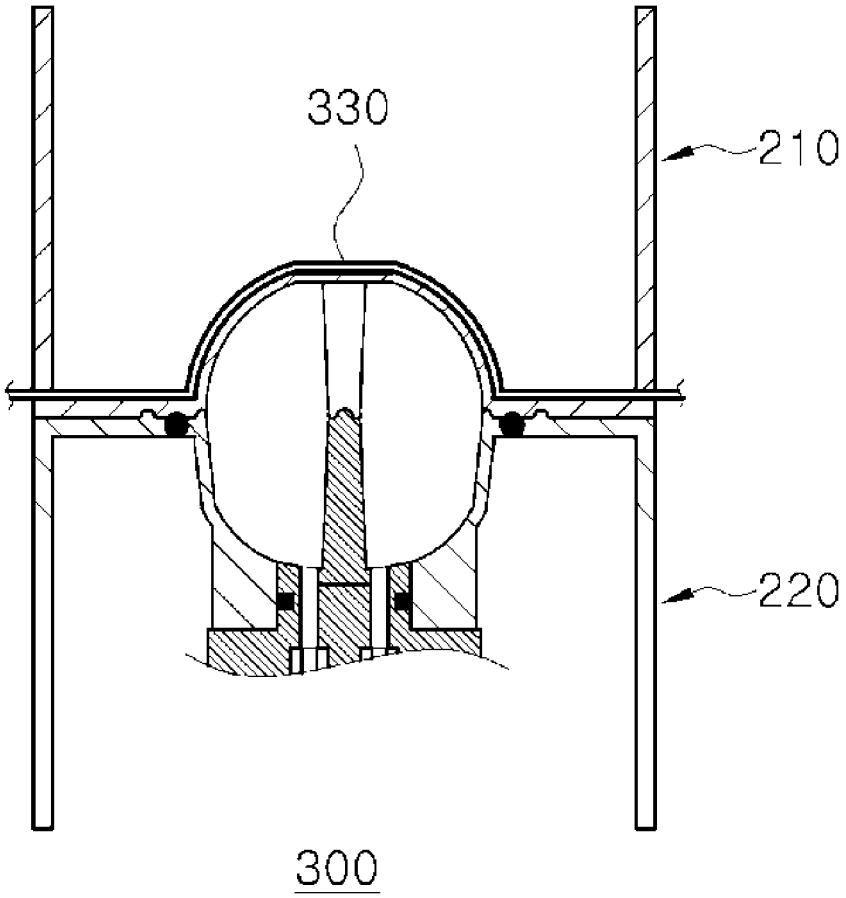

Furthermore, referring to FIG. 2C, the cooling part 300 may include a cooling chamber 330 that is formed in the first mold 210 such that the refrigerant circulates therein. Here, the refrigerant may be brine or a gas of a low temperature.

Figure 2D:
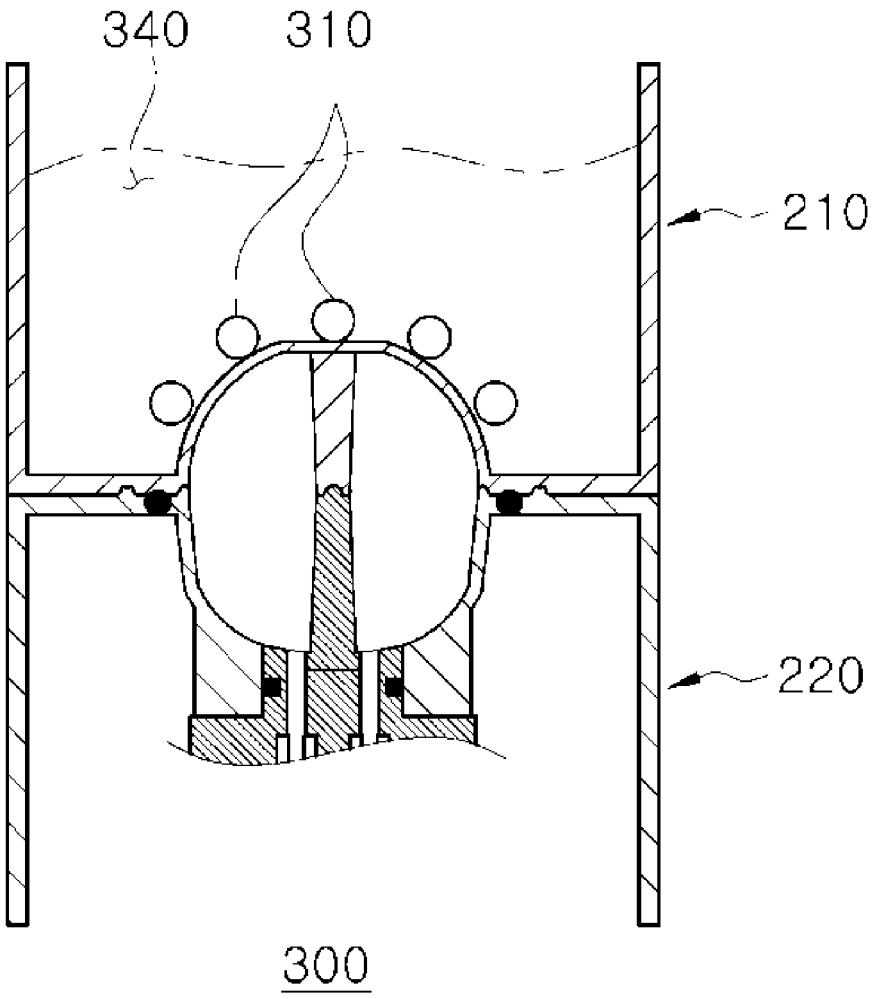

Furthermore, referring to FIG. 2D, the cooling part 300 may include a cooling tank 340 that is provided in the first mold 210 and in which brine is filled, and the plurality of cooling channels 310 that is formed in the cooling tank 340 such that the refrigerant circulates therein. Here, the refrigerant may be a gas of a low temperature.

Figure 2E:
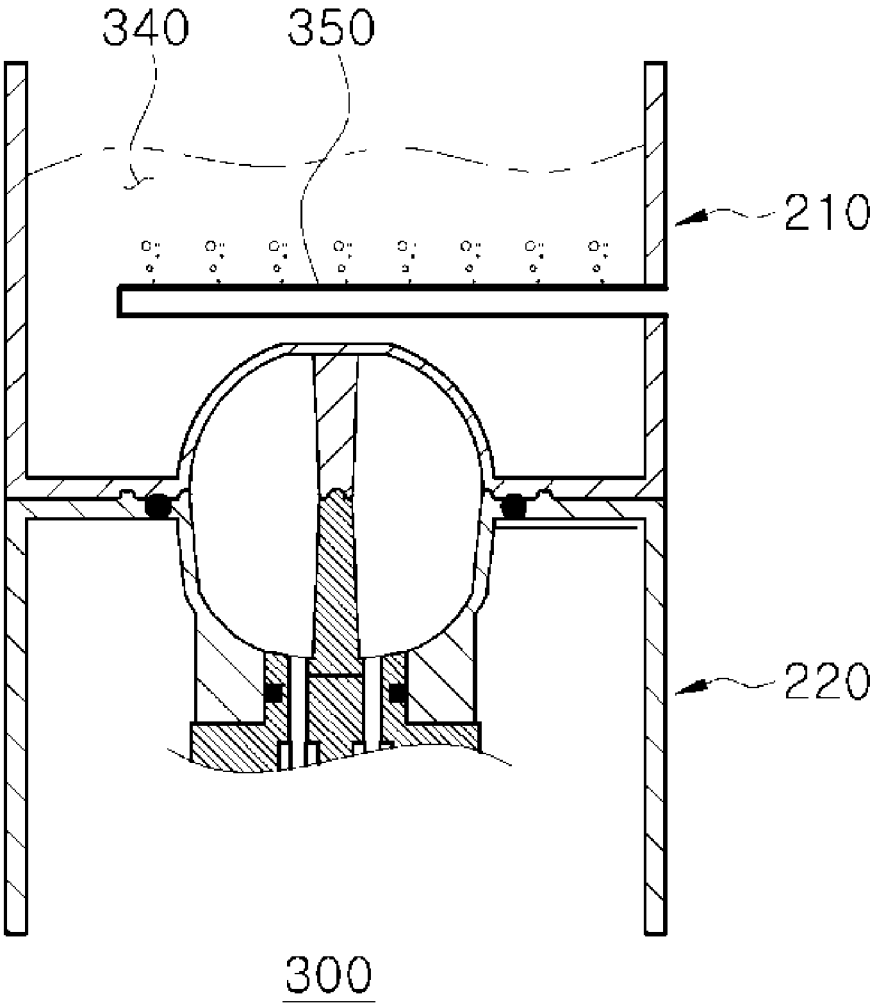

Furthermore, referring to FIG. 2E, the cooling part 300 may include a cooling tank 340 that is provided in the first mold 210 and in which brine is filled, and a cooling pipe 350 that is formed in the cooling tank 340 such that the refrigerant circulates therein. Here, the refrigerant may be a gas of a low temperature.

The fluid circulation part 400 is provided between the reservoir tank 110 and the mold 200, and circulates the liquid between the reservoir tank 110 and the cavity 250 continuously or intermittently while the liquid is frozen in the cavity 250. In this way, when the liquid circulates, bubbles contained in the liquid frozen in the cavity 250 are removed, and thus the transparent ice 10 may be manufactured in the cavity 250.

The fluid circulation part 400 may be controlled by a controller 900. The controller 900 may include an image sensor that photographs a frozen state of the liquid filled in the cavity 250 to obtain an image, and may identify the frozen state of the liquid filled in the cavity 250 according to data transmitted by the image sensor to operate the fluid circulation part 400. For example, the controller 900 may include a microcomputer, a programmable logic controller (PLC), and the like.

The fluid circulation part 400 may include a liquid supply pump 410, a first flow passage 422, a second flow passage 424, and an air pump 430.

The liquid supply pump 410 pumps and supplies the liquid stored in the reservoir tank 110 to the cavity 250 formed by the first mold 210 and the second mold 220.

The first flow passage 422 and the second flow passage 424 may be pipes that communicate the reservoir tank 110 and the cavity 250. The first flow passage 422 and the second flow passage 424 may pass through a manifold 420.

The first flow passage 422 guides flows of the liquid pumped by the liquid supply pump 410 to the cavity 250.

The second flow passage 424 guides flows of the liquid discharged from the cavity 250 to the reservoir tank 110.

The air pump 430 may suction the air in the cavity 250 formed by the first mold 210 and the second mold 220, or may discharge the air stored in the reservoir tank 110 into the cavity 250.

Here, the liquid supply pump 410 is provided on the first flow passage 422, and the air pump 430 is provided on the second flow passage 424. Furthermore, although it is illustrated in the present embodiment that the liquid supply pump 410 and the air pump 430 are disposed on a lower side of the cavity 250, the inventive concept is limited thereto, and may be disposed on any one of an upper side, a left side, and a right side of the cavity 250, that is, on one side of a circumference of the cavity 250. Furthermore, according to disposition locations of the liquid supply pump 410 and the air pump 430, the fluid circulation part 400 including the manifold 420 may be disposed on any one of the upper side, the left side, and the right side of the cavity 250, that is, on one side of the circumference of the cavity 250.

Circulating the liquid between the reservoir tank 110 and the cavity 250 by the fluid circulation part 400 having the above configuration may be repeating a first process of pumping and supplying the liquid stored in the reservoir tank 110 to the cavity 250 through the first flow passage 422 by the liquid supply pump 410 and a second process of discharging the liquid pumped and supplied to the cavity 250 into the reservoir tank 110 through the second flow passage 424, as one cycle. Here, the liquid supply pump 410 may be controlled by the controller 900.

Meanwhile, the controller 900 may relieve the remaining liquid left in the cavity 250 to the reservoir tank 110 before the ice 10 frozen in the cavity 250 is separated from the cavity 250. For example, the controller 900 may stop the liquid supply pump 410 and the air pump 430 to relieve the remaining liquid left in the cavity 250 to the reservoir tank 110 by naturally dropping it.

After relieving the remaining liquid left in the cavity 250 to the reservoir tank 110, the controller 900 may operate the air pump 430 to separate the ice 10 frozen in the cavity 250 from the cavity 250 by discharging the air accommodated in the reservoir tank 110 into the cavity 250.

The manifold 420 may be passed through by the second mold 220, and may be elevated with respect to the cavity 250 of the second mold 220. In detail, the manifold 420 may be raised with respect to the cavity 250 of the second mold 220 such that an inner surface of the manifold 420 and an inner surface of the second mold 220 are connected to each other. That is, the inner surface of the manifold 420 and the inner surface of the second mold 220 are disposed to correspond to an inner surface of the final product. Furthermore, the manifold 420 may be lowered to a location that is spaced apart from the cavity 250 of the second mold 220.

As will be described later, the elevation of the manifold 420 may be controlled by the controller 900.

For example, the controller 900 may raise the manifold 420 with respect to the cavity 250 of the second mold 220 such that the inner surface of the manifold 420 and the inner surface of the second mold 220 may be disposed to be continuous to each other before the liquid filled in the cavity 250 is frozen to a specific ratio of a volume of the cavity 250. (See FIG. 9)

Then, because the liquid filled in the cavity 250 is made to circulate between the reservoir tank 110 and the cavity 250 by the liquid supply pump 410, it is difficult to freeze the liquid filled in the cavity 250 into ice of a shape corresponding to the final product.

Accordingly, the controller 900 may lower the manifold 420 to a location that is spaced apart from the cavity 250 of the second mold 220 such that the ice frozen in the cavity 250 grows up to the shape corresponding to final product after the liquid filled in the cavity 250 is frozen to the specific ratio of the volume of the cavity 250. (see FIG. 10). Then, processes of relieving the remaining liquid left in the cavity 250 through the first flow passage 422 and the second flow passage 424 may be performed simultaneously.

In the example, the specific ratio of the volume of the cavity 250 set by the controller 900 is not particularly limited, but may be 80% to 90%.

In the example, the controller 900 may determine whether the liquid filled in the cavity 250 is frozen to the specific ratio of the volume of the cavity 250 by a medium of a period of time, for which the liquid filled in the cavity 250 is frozen.

Furthermore, the controller 900 may determine a reference for freezing the liquid filled in the cavity 250 to the specific ratio of the volume of the cavity 250 by a medium of data transmitted from a distance sensor that measures a distance between the ice frozen in the cavity 250 and the manifold 420.

Referring to FIG. 1, the transparent ice manufacturing system according to the embodiment of the inventive concept may further include a relief valve 500.

The relief valve 500 may be provided in the reservoir tank 110 and may eject the air in the reservoir tank 110 to the outside when a pressure in the reservoir tank 110 is a preset pressure or more. In this way, because the air in the reservoir tank 110 is ejected to the outside by the relief valve 500, the internal pressure in the reservoir tank 110 may be maintained at a specific pressure. For example, the relief valve 500 may change the preset pressure according to a magnitude of a control current set by the controller 900, in an electronic proportional scheme.

The transparent ice manufacturing system according to the embodiment of the inventive concept may further include a coupling recess 710, a coupling boss 720, and an agitation part 800.

Referring to FIGS. 3 and 4, the coupling recess 710 is recessed on a facing surface of the first mold 210, which faces the second mold 220. The coupling recess 710 may be recessed along a circumference of the cavity 250 of the first mold 210 or in one area of the circumference.

The coupling boss 720 may protrude on a facing surface of the second mold 220, which faces the first mold 210, to be coupled to the coupling recess 710 to be separable, and may arrange the first mold 210 and the second mold 220 while combining them. The coupling boss 720 may protrude along a circumference of the cavity 250 of the second mold 220 or in one area of the circumference in correspondence to the coupling recess 710.

Accordingly, because the first mold 210 and the second mold 220 are combined with each other by the coupling recess 710 and the coupling boss 720, leakage of the liquid filled in the cavity 250 may be prevented, and intrusion of the air in the cavity 250 may be prevented.

Here, although it is illustrated in the present embodiment that the coupling recess 710 is provided in the first mold 210 and the coupling boss 720 is provided in the second mold 220, the inventive concept is not limited thereto, but the coupling recess 710 may be provided in the second mold 220 and the coupling boss may be provided in the first mold.

Furthermore, an O-ring 730 for sealing the first mold 210 and the second mold 220 may be provided on a combining surface of the first mold 210 and the second mold 220 to maintain a sealed state of the cavity 250 formed by the first mold 210 and the second mold 220.

Referring to FIG. 5, the agitation part 800 may be provided at an end of the manifold 420 that faces the cavity 250 to agitate the liquid filled in the cavity 250 through the fluid circulation part 400. In this way, because the liquid filled in the cavity 250 is additionally agitated through the agitation part 800, generation of bubbles in the ice frozen in the cavity 250 may be remarkably alleviated. For example, the agitation part 800 is not particularly limited, but may include an impeller, a BLDC motor, a vibration element, a piezoelectric element, and an ultrasonic vibrator.

A process of manufacturing the transparent ice 10 by the transparent ice manufacturing system according to an embodiment of the inventive concept will be described. The following process may be performed by the controller 900.

FIGS. 6 to 11 are schematic views illustrating a process of manufacturing transparent ice 10 by the transparent ice manufacturing system according to the embodiment of the inventive concept.

First, as illustrated in FIG. 6, in a state in which the first mold 210 and the second mold 220 are spaced apart from each other, the first mold 210 and the second mold 220 are combined with each other by moving the first mold 210 in a direction that faces the second mold 220.

Figure 7:
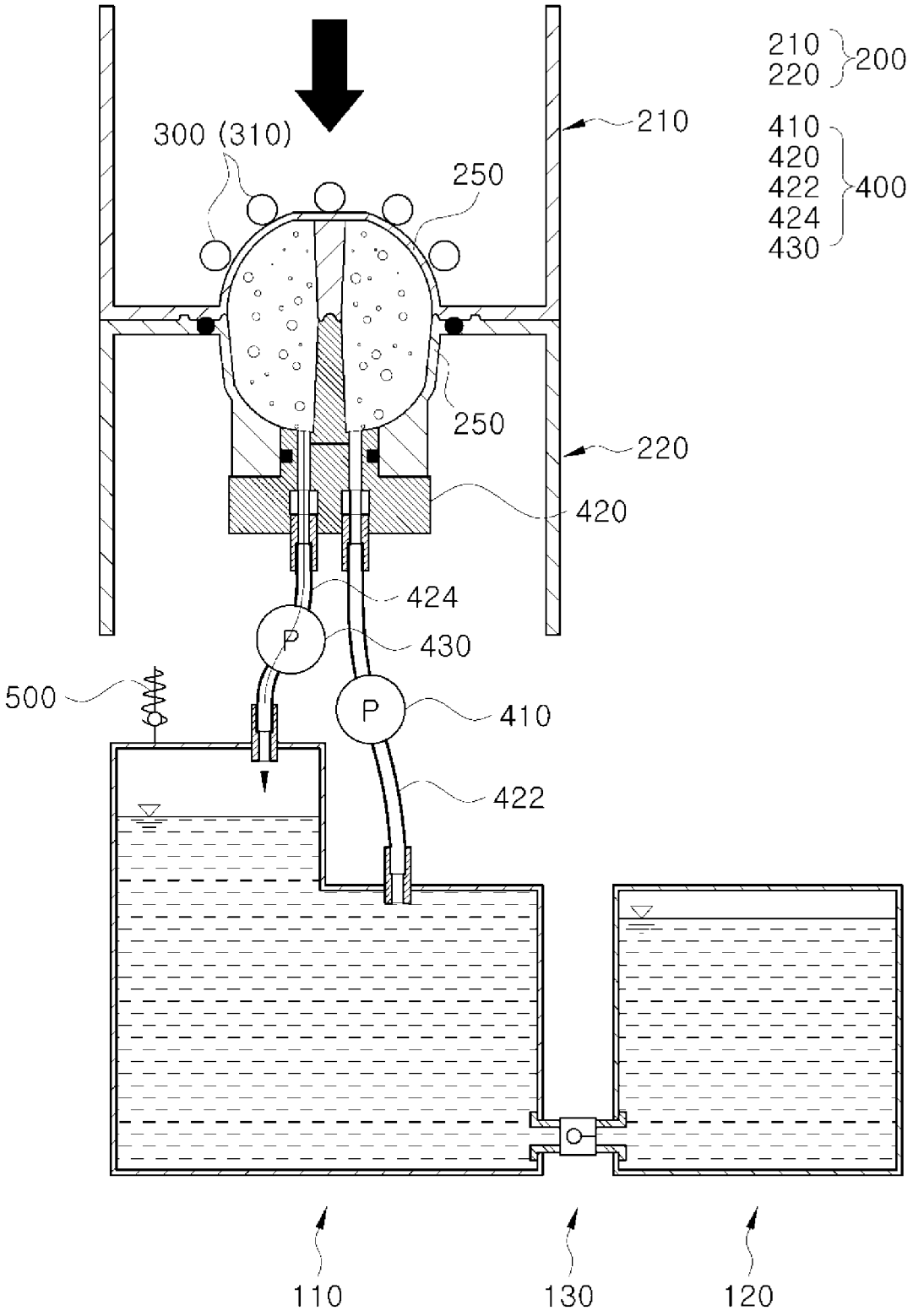

Next, as illustrated in FIG. 7, the air in the cavity 250 formed by the first mold 210 and the second mold 220 is suctioned through the second flow passage 424 by driving the air pump 430.

Figure 8:
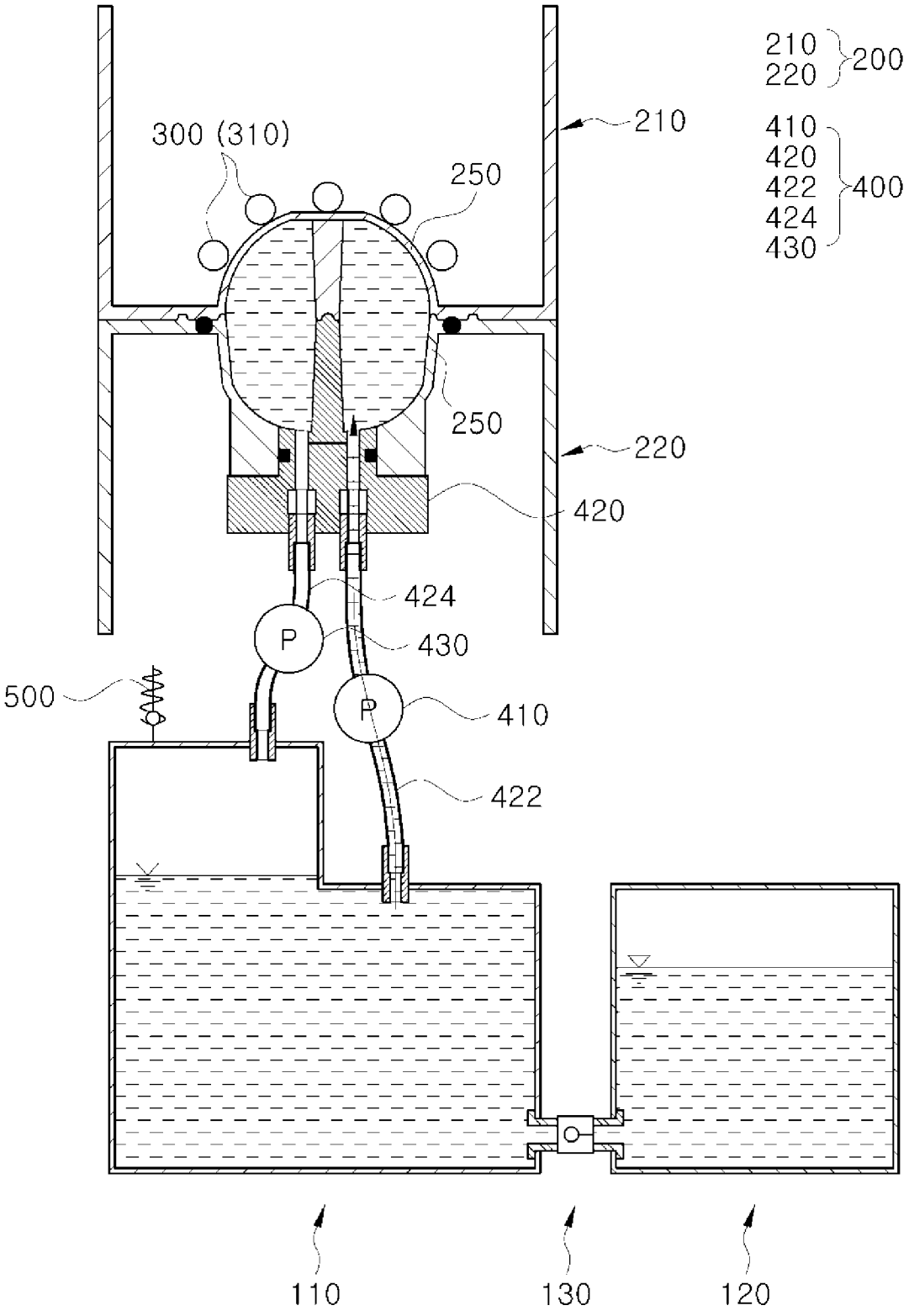

Next, as illustrated in FIG. 8, the liquid stored in the reservoir tank 110 is filled in the cavity 250 through the first flow passage 422 by driving the liquid supply pump 410. Then, the liquid supply part 130 may supply the liquid stored in the liquid tank 120 to the reservoir tank 110 such that a constant amount of the liquid stored in the reservoir tank 110 is maintained.

Here, the liquid supplied from the liquid tank 120 to the reservoir tank 110 may be the preliminarily cooled liquid. Accordingly, as the preliminarily cooled liquid is filled in the cavity 250, a freezing efficiency of the liquid filled in the cavity 250 may be improved later.

Figure 9:
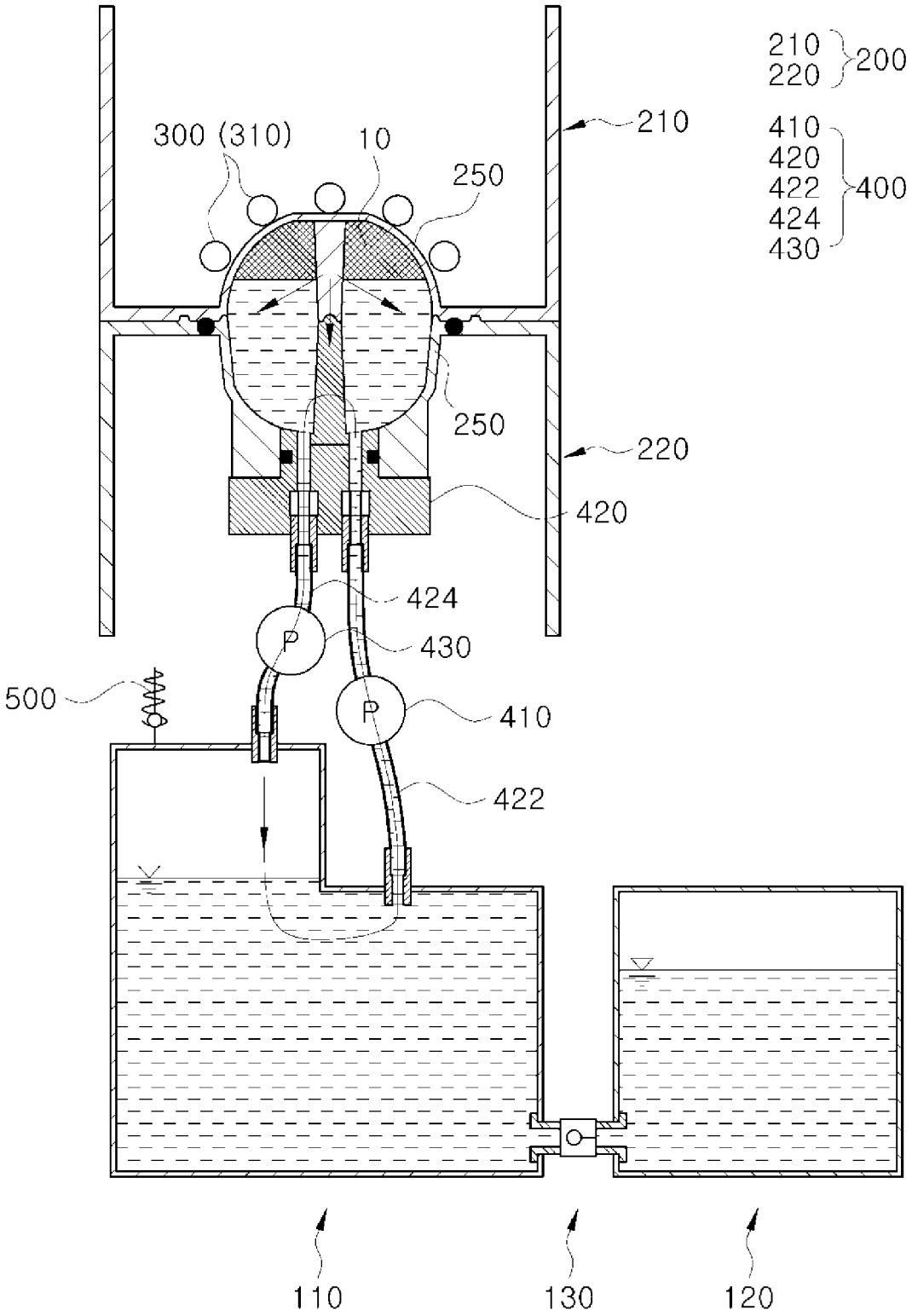

Thereafter, as illustrated in FIG. 9, when the first mold 210 is cooled by driving the cooling part 300, the cooling heat of the cooling part 300 is transferred from the circumference of the first mold 210 toward the circumference of the second mold 220 via a center of the cavity 250 to form ice, for example, the liquid filled in the cavity 250 is gradually frozen from the first mold 210 to the second mold 220 to manufacture the ice 10 of a desired shape. Then, the ice 10 is frozen while growing up from the first mold 210 to the second mold 220.

In this way, while the liquid filled in the cavity 250 is frozen, a first process of pumping and supplying the liquid stored in the reservoir tank 110 to the cavity 250 through the first flow passage 422 by the liquid supply pump 410 and a second process of discharging the liquid pumped and supplied to the cavity 250 into the reservoir tank 110 through the second flow passage 424 are repeated as one cycle. In this way, when the liquid circulates, bubbles contained in the liquid frozen in the cavity 250 are removed, and thus the transparent ice 10 may be manufactured.

Figure 10:
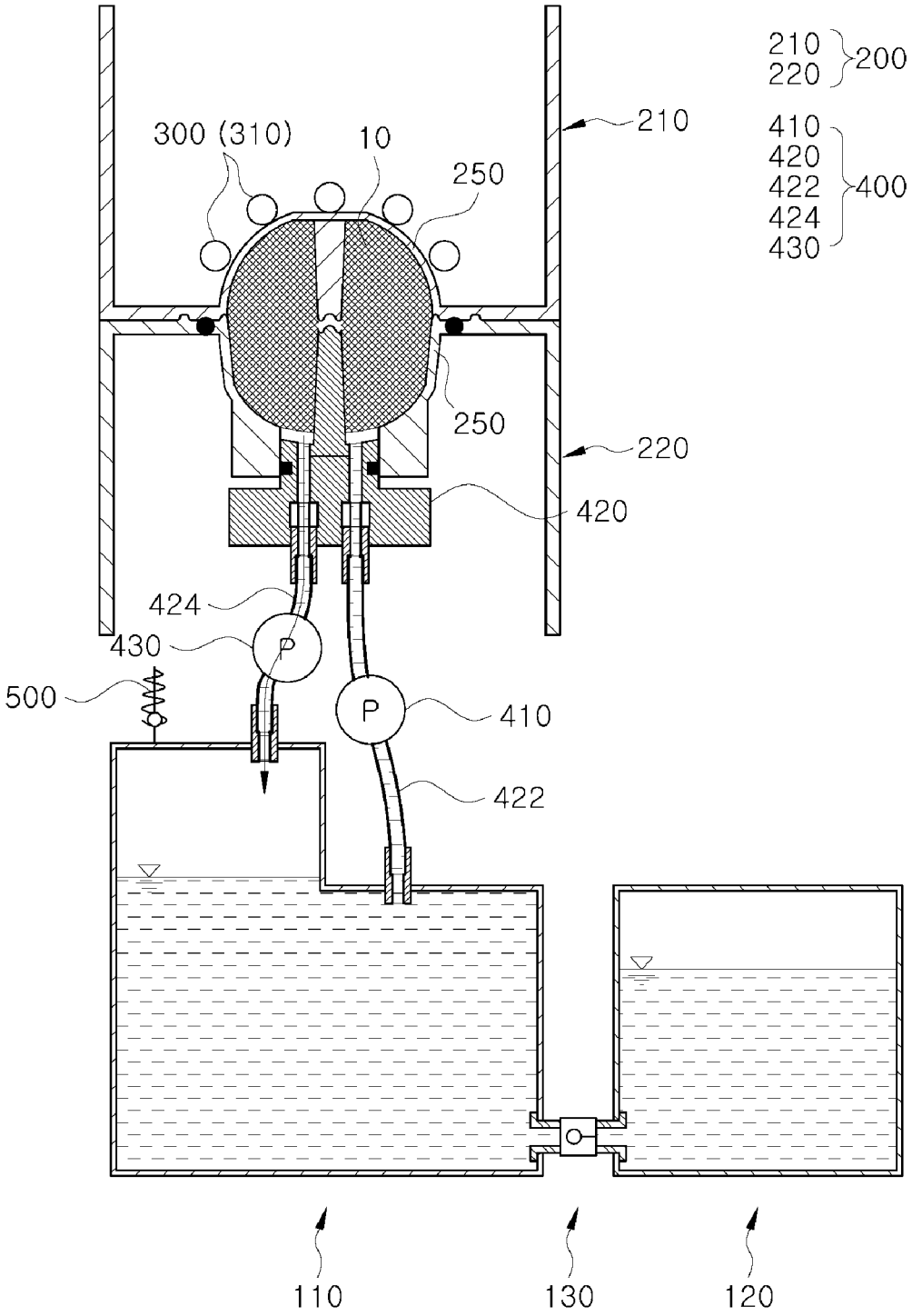

Next, when the ice frozen in the cavity 250 reaches the preset size, as illustrated in FIG. 10, the remaining liquid left in the cavity 250 is relieved through the first flow passage 422 and the second flow passage 424 before the ice 10 is separated from the cavity 250.

Figure 11:
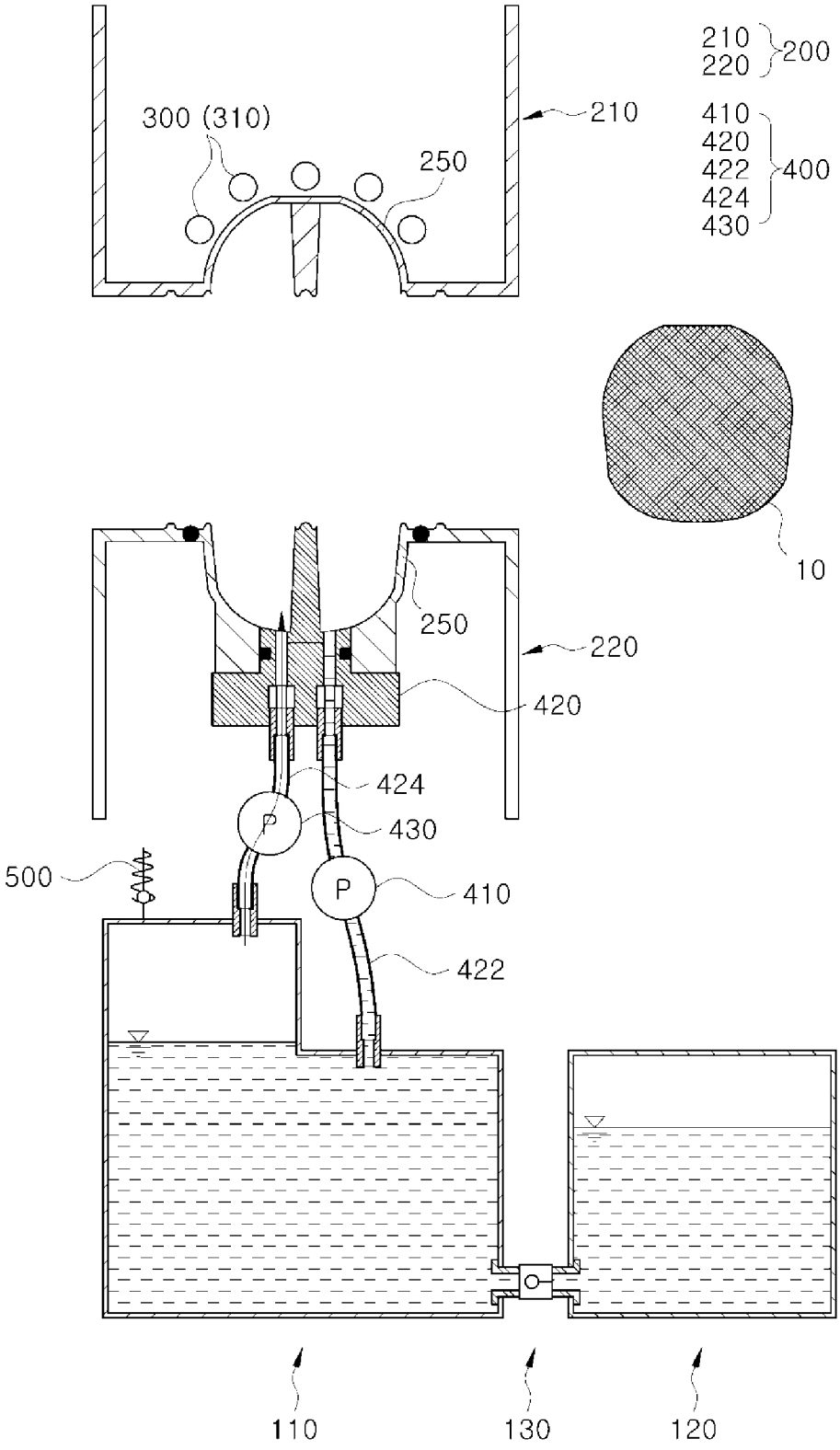

Next, as illustrated in FIG. 11, the air stored in the reservoir tank 110 is discharged into the cavity 250 through the second flow passage 424 by driving the air pump 430. As a result, the ice 10 separated from the cavity 250 is separated from the cavity 250 by the air discharged from the reservoir tank 110, and the transparent ice of a desired shape may be obtained.

Figure 12:
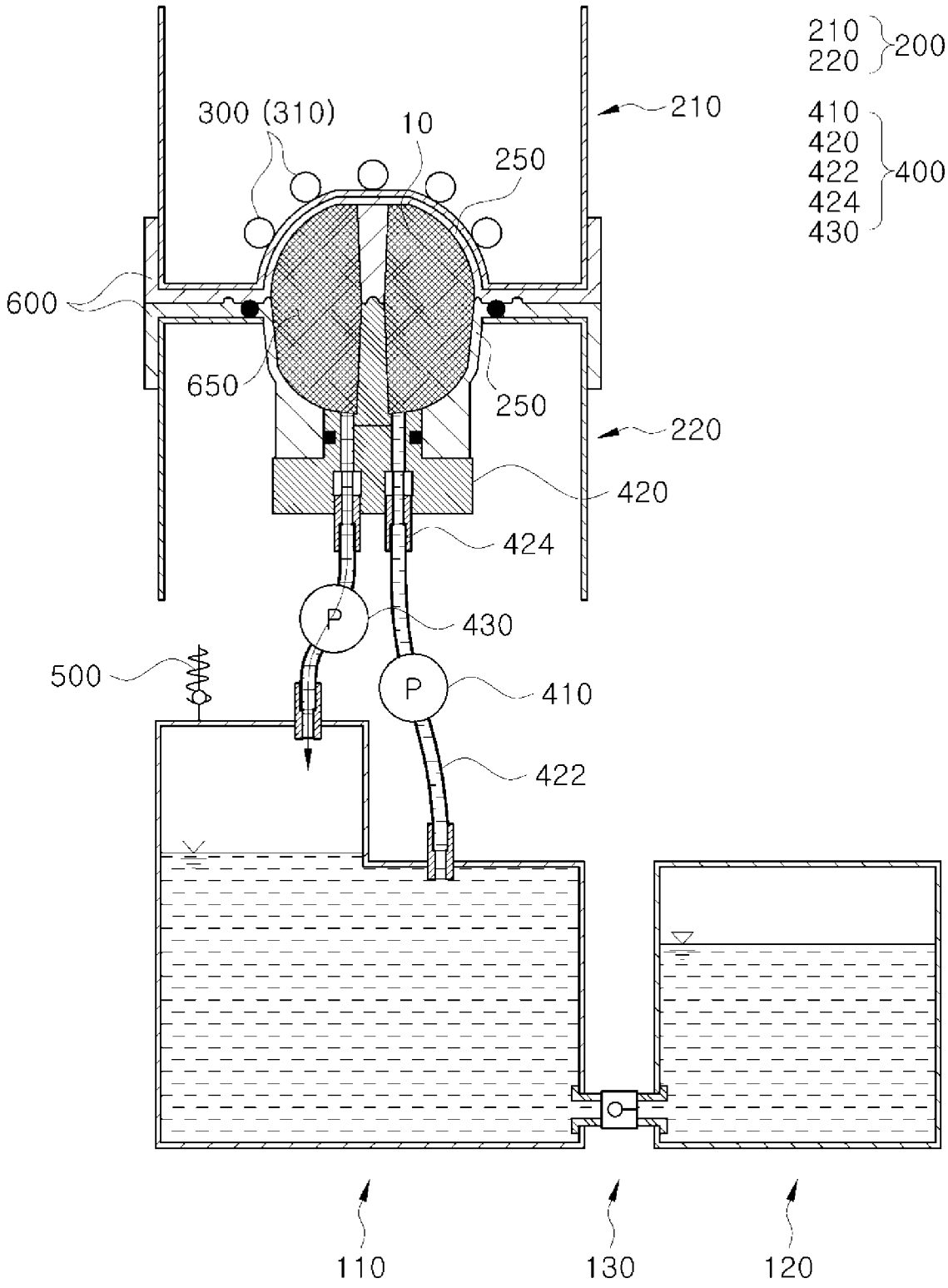
FIG. 12 is a schematic view illustrating a transparent ice manufacturing system according to another embodiment of the inventive concept.
Figure 13:
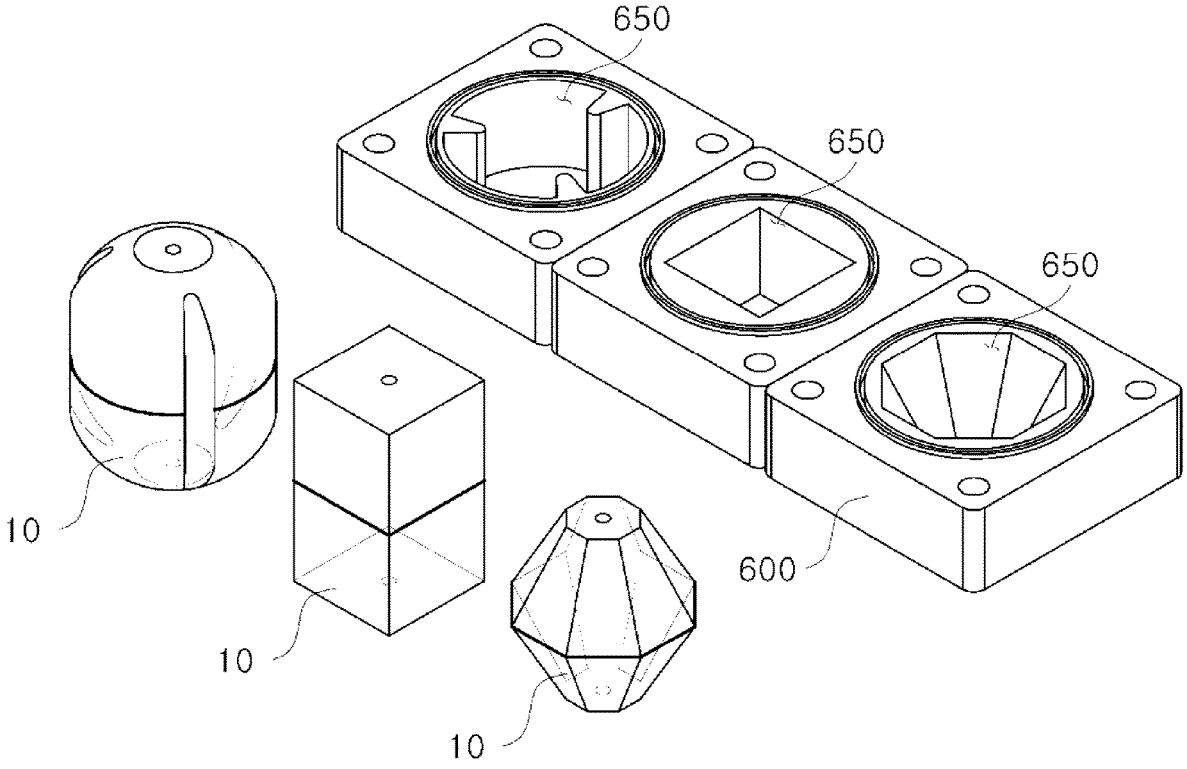
FIG. 13 is a perspective view illustrating a first mold, a second mold, and a pair of forming molds of a transparent ice manufacturing system according to another embodiment of the inventive concept.

FIG. 12 is a schematic view illustrating a transparent ice manufacturing system according to another embodiment of the inventive concept. FIG. 13 is a perspective view illustrating a first mold, a second mold, and a pair of forming molds of a transparent ice manufacturing system according to another embodiment of the inventive concept.

Although it has been described that the transparent ice manufacturing system according to the above-described embodiment of the inventive concept manufactures ice through the cavity 250 formed by the first mold 210 and the second mold 220 by circulating the liquid stored in the reservoir tank 110 between the first mold 210 and the second mold 220, and the reservoir tank 110, in another embodiment, as illustrated in FIG. 12, a pair of forming molds 600 having an auxiliary cavity 650 for forming ice of a specific shape are provided in an interior thereof such that the pair of forming molds 600 are mounted on the first mold 210 and the second mold 220, whereby ice of various shapes may be manufactured through the auxiliary cavity 650 by circulating the liquid stored in the reservoir tank 110 between the auxiliary cavity 650 and the reservoir tank 110.

The pair of forming molds 600 may constitute a plurality of groups having auxiliary cavities 650 of different shapes. Accordingly, because any one of the plurality of groups may be selectively mounted on the first mold 210 and the second mold 220 to manufacture the ice 10 of a shape corresponding to the auxiliary cavity 650 of the corresponding group, the ice 10 of various shapes may be manufactured for respective groups.

Furthermore, when ice is manufactured by using the pair of forming molds 600, the coupling recess 710 and the coupling boss 720, which have been described above, may be provided in the pair of forming molds 600, respectively. Furthermore, an O-ring may be provided between the pair of forming molds 600 to maintain a sealed state of the auxiliary cavity formed by the pair of forming molds 600.

A method for manufacturing transparent ice by using the transparent ice manufacturing system according to an embodiment of the inventive concept includes an operation of suctioning the air in the cavity 250 formed by the mold 200, an operation of filling the liquid stored in the reservoir tank 110 in the cavity 250, an operation of cooling the one area of the mold 200 to manufacture the ice while freezing the liquid from the one area to the opposite area of the mold 200, by the cooling part, an operation of circulating the liquid between the reservoir tank 110 and the cavity 250 while the liquid is frozen in the cavity 250, an operation of relieving the remaining liquid left in the cavity 250 to the reservoir tank 110 before the ice frozen in the cavity 250 is separated from the cavity 250, and an operation of separating the ice frozen in the cavity 250 from the cavity by discharging the air accommodated in the reservoir tank 110 into the cavity 250.

According to the inventive concept, in the transparent ice manufacturing system and the method for manufacturing transparent ice by using the same according to the embodiments of the inventive concept, a manufacturing time for the transparent ice may be shortened by simplifying a manufacturing process for the transparent ice, energy consumptions such as electric power that is necessary for manufacturing the transparent ice may be reduced, and a manufacturing efficiency of the transparent ice may be enhanced.

Furthermore, according to the transparent ice manufacturing system and the method for manufacturing transparent ice by using the same according to the embodiments of the inventive concept, a quality of transparent ice may be easily managed, and transparent ice of various shapes and various kinds may be manufactured.

Furthermore, according to the transparent ice manufacturing system and the method for manufacturing transparent ice by using the same according to the embodiments of the inventive concept, because transparent ice is manufactured by filling the liquid in the cavity of a shape corresponding to a final product and then freezing the liquid, parts that are not necessary in the transparent ice may be prevented from being discarded through the carving, the crushing, and the forming and raw materials may be prevented from being wasted.

According to the inventive concept, a manufacturing time for the transparent ice may be shortened by simplifying a manufacturing process for the transparent ice, energy consumptions such as electric power that is necessary for manufacturing the transparent ice may be reduced, and a manufacturing efficiency of the transparent ice may be enhanced.

Furthermore, a quality of transparent ice may be easily managed, and transparent ice of various shapes and various kinds may be manufactured.

In addition, because transparent ice is manufactured by filling the liquid in the cavity of a shape corresponding to a final product and then freezing the liquid, parts that are not necessary in the transparent ice may be prevented from being discarded through the carving, the crushing, and the forming and raw materials may be prevented from being wasted.

The effects of the inventive concept are not limited thereto, and other unmentioned effects of the inventive concept may be clearly appreciated by those skilled in the art from the following descriptions.

Although the exemplary embodiments of the inventive concept have been described with reference to the accompanying drawings, it will be understood by those skilled in the art to which the inventive concept pertains that the inventive concept can be carried out in other detailed forms without changing the technical spirits and essential features thereof. Therefore, the above-described embodiments are exemplary in all aspects, and should be construed not to be restrictive.

What is claimed is:

1. A transparent ice manufacturing system comprising:

a reservoir tank, in which a liquid is stored;

a mold having a cavity, in which the liquid supplied from the reservoir tank is filled to form ice;

a cooling part configured to cool one area of the mold to manufacture the ice while freezing the liquid from the one area to an opposite area of the mold; and a fluid circulation part provided between the reservoir tank and the mold, and configured to circulate the liquid between the reservoir tank and the cavity while the liquid is frozen in the cavity, wherein the mold includes a first mold and a second mold that are coupled to each other to be separable while forming the cavity, wherein the fluid circulation part includes:

a liquid supply pump configured to pump and supply the liquid stored in the reservoir tank to the cavity formed by the first mold and the second mold;

a first flow passage configured to guide flows of the liquid pumped by the liquid supply pump to the cavity; and a second flow passage configured to guide flows of the liquid discharged from the cavity to the reservoir tank, and wherein the fluid circulation part further includes:

an air pump configured to suction air in the cavity formed by the first mold and the second mold, or discharge air stored in the reservoir tank into the cavity.

2. The transparent ice manufacturing system of claim 1, further comprising:

a pair of forming molds having an auxiliary cavity that forms ice of a specific shape, and coupled to a cavity formed in the first mold and a cavity formed in the second mold to be separable.

3. The transparent ice manufacturing system of claim 1, further comprising:

a coupling recess formed in any one of the first mold and the second mold; and a coupling boss protruding from the other of the first mold and the second mold, coupled to the coupling recess to be separable, and combining and arranging the first mold and the second mold.

4. The transparent ice manufacturing system of claim 1, wherein the liquid supply pump is provided in the first flow passage, and the air pump is provided in the second flow passage.

5. The transparent ice manufacturing system of claim 1, further comprising:

a controller configured to relieve a remaining liquid left in the cavity to the reservoir tank before the ice frozen in the cavity is separated from the cavity.

6. The transparent ice manufacturing system of claim 5, wherein the controller configured to relieve the remaining liquid left in the cavity to the reservoir tank and then separating the ice frozen in the cavity from the cavity by discharging the air accommodated in the reservoir tank into the cavity.

7. The transparent ice manufacturing system of claim 1, further comprising:

a relief valve provided in the reservoir tank, and configured to eject air in the reservoir tank to an outside when a pressure in the reservoir tank is a preset pressure or more.

8. The transparent ice manufacturing system of claim 1, further comprising:

an agitation part configured to agitate the liquid filled in the cavity.

9. The transparent ice manufacturing system of claim 1, further comprising:

a liquid tank, in which the liquid supplied to the reservoir tank is stored; and a liquid supply part configured to supply the liquid stored in the liquid tank to the reservoir tank such that a constant amount of the liquid stored in the reservoir tank is maintained.

10. The transparent ice manufacturing system of claim 1, wherein the cooling part is provided in any one of the first mold and the second mold, and the fluid circulation part is provided in the other of the first mold and the second mold.

11. A method for manufacturing transparent ice using a transparent ice manufacturing system comprising: a reservoir tank, in which a liquid is stored, a mold having a cavity, in which the liquid supplied from the reservoir tank is filled to form ice, a cooling part configured to cool one area of the mold to manufacture the ice while freezing the liquid from the one area to an opposite area of the mold, and a fluid circulation part provided between the reservoir tank and the mold, and configured to circulate the liquid between the reservoir tank and the cavity while the liquid is frozen in the cavity, the method comprising:

suctioning air in the cavity formed by the mold;

filling the liquid stored in the reservoir tank in the cavity;

cooling the one area of the mold to manufacture the ice while freezing the liquid from the one area to the opposite area of the mold, by the cooling part;

circulating the liquid between the reservoir tank and the cavity while the liquid is frozen in the cavity;

relieving a remaining liquid left in the cavity to the reservoir tank before the ice frozen in the cavity is separated from the cavity; and separating the ice frozen in the cavity from the cavity by discharging the air accommodated in the reservoir tank into the cavity.

* * * * *